United States Patent [19]

Madle et al.

[11] Patent Number: 5,064,575

[45] Date of Patent: Nov. 12, 1991

[54] METHOD AND DEVICE FOR THE LOADING AND SEALING OF A DOUBLE CONTAINER SYSTEM FOR THE STORAGE OF RADIOACTIVE MATERIAL AND A SEAL FOR THE DOUBLE CONTAINER SYSTEM

[76] Inventors: Wolfgang Madle, Falltorweg 43, 6906 Leimen; Norbert Gawlik, Neunkirchener Weg 7, 5908 Neunkirchen; Franz W. Popp, Kuhstrasse 5, D-3002 Wedemark, all of Fed. Rep. of Germany

[21] Appl. No.: 325,854

[22] Filed: Mar. 20, 1989

Related U.S. Application Data

[62] Division of Ser. No. 99,912, Sep. 22, 1987, Pat. No. 4,847,009.

[30] Foreign Application Priority Data

Sep. 23, 1986 [DE] Fed. Rep. of Germany ..... 3632270

[51] Int. Cl.[5] ..... G21F 9/12; G21F 5/00; G21C 19/00

[52] U.S. Cl. ..... 252/633; 228/184; 250/506.1; 250/507.1; 376/272; 219/54; 219/61.4; 219/121.45; 219/136; 220/415; 220/DIG. 29

[58] Field of Search ..... 252/633, 626; 250/506.1, 507.1; 376/272; 220/1 T, 415, 67, 256, DIG. 29; 228/140, 175, 184; 219/54, 61.4, 121.45, 136

[56] References Cited

U.S. PATENT DOCUMENTS

| | | | |
|---|---|---|---|
| 4,330,711 | 5/1982 | Ahner et al. | 250/506.1 |
| 4,445,042 | 4/1984 | Baatz et al. | 250/506.1 |
| 4,569,818 | 2/1986 | Popp et al. | 376/272 |
| 4,572,959 | 2/1986 | Popp et al. | 250/506.1 |
| 4,594,214 | 6/1986 | Popp et al. | 376/272 |
| 4,596,688 | 6/1986 | Popp | 376/272 |
| 4,673,814 | 6/1987 | Schroeder et al. | 250/506.1 |

*Primary Examiner*—Howard J. Locker

[57] ABSTRACT

A container for a radioactive material in which the cover is welded to the container by a dual weld disposed in a welding gap between the cover and the container wall, the gap having a bottom formed by opposed flanges on the cover and the wall. The root layer of the weld is formed by a tungsten electrode gas shielded arc welding process. A superimposed added layer is formed by a submerged arc welding process.

4 Claims, 7 Drawing Sheets

METHOD AND DEVICE FOR THE LOADING AND SEALING OF A DOUBLE CONTAINER SYSTEM FOR THE STORAGE OF RADIOACTIVE MATERIAL AND A SEAL FOR THE DOUBLE CONTAINER SYSTEM

This is a divisional of application Ser. No. 099,912, filed Sept. 22, 1987 now U.S. Pat. No. 4,847,009.

The invention concerns a double container for the storage of radioactive material having an improved, seal.

From Swiss LP 650,354, a container combination is known for the transport and storage of fuel elements which consists of a removable inner container and an outer container, in which each of the containers has its own cover. The loading of the inner container takes place, as is known, in a hot cell. But the final sealing with the cover must also take place in the hot cell, which can only be accomplished with a considerable outlay, since the cover must be welded to the container. Even if the welding of the cover and container already offers good security, there is a need for a further increase in the security of the containment of the radioactive material.

The object of the present invention is to provide a seal of the type which can be easily effected and make the containment of the radioactive materials even more secure.

The object is achieved by sealing the radioactive material in a container within the hot cell and subsequently welding an outer cover on the container outside the hot cell.

Advantages and practical further developments of these solutions for sealing a double container system are described in detail in this specification.

In accordance with the present invention, an additional outer cover in the form of a sealing plug is provided for the inner container of the double container system. The welding of this outer cover after the inner cover has been screwed into the loaded inner container in a shielded region (hot cell), or, in the case of the double container system, locked within the cell aperture of the hot cell, takes place outside of this shielded region since the screw-type cover takes care of the required shielding of the radioactivity. Screwing the inner cover into the container inside the hot cell, or in the case of the double container system which is locked in the hot cell, requires only a comparatively low outlay.

Welding outside of the shielded region (outside of a hot cell) reduces the outlay for the welding process and for the devices required considerably. By means of the additional outer cover, the containment of the radioactive materials is more secure. When we refer to radioactive material, it is understood that in the condition considered here it is enclosed in its own sheath (box, metal mould) and thus is loaded into the inner container with its sheath. All processes for loading and sealing take place on the inner container which is inserted in the shielding container. It is particularly advantageous that the welding of the outer cover to the inner container be carried out with the inner container already inserted in the shielding container.

The invention will be explained in more detail in conjunction with the accompanying drawing in which FIG. 1*a* shows schematically the method steps in a first method for the loading and sealing of a double container system designed according to the invention.

FIG. 1*b* shows schematically the method steps in a second method for the loading and sealing of a double container system designed according to the invention.

Figure 1A:
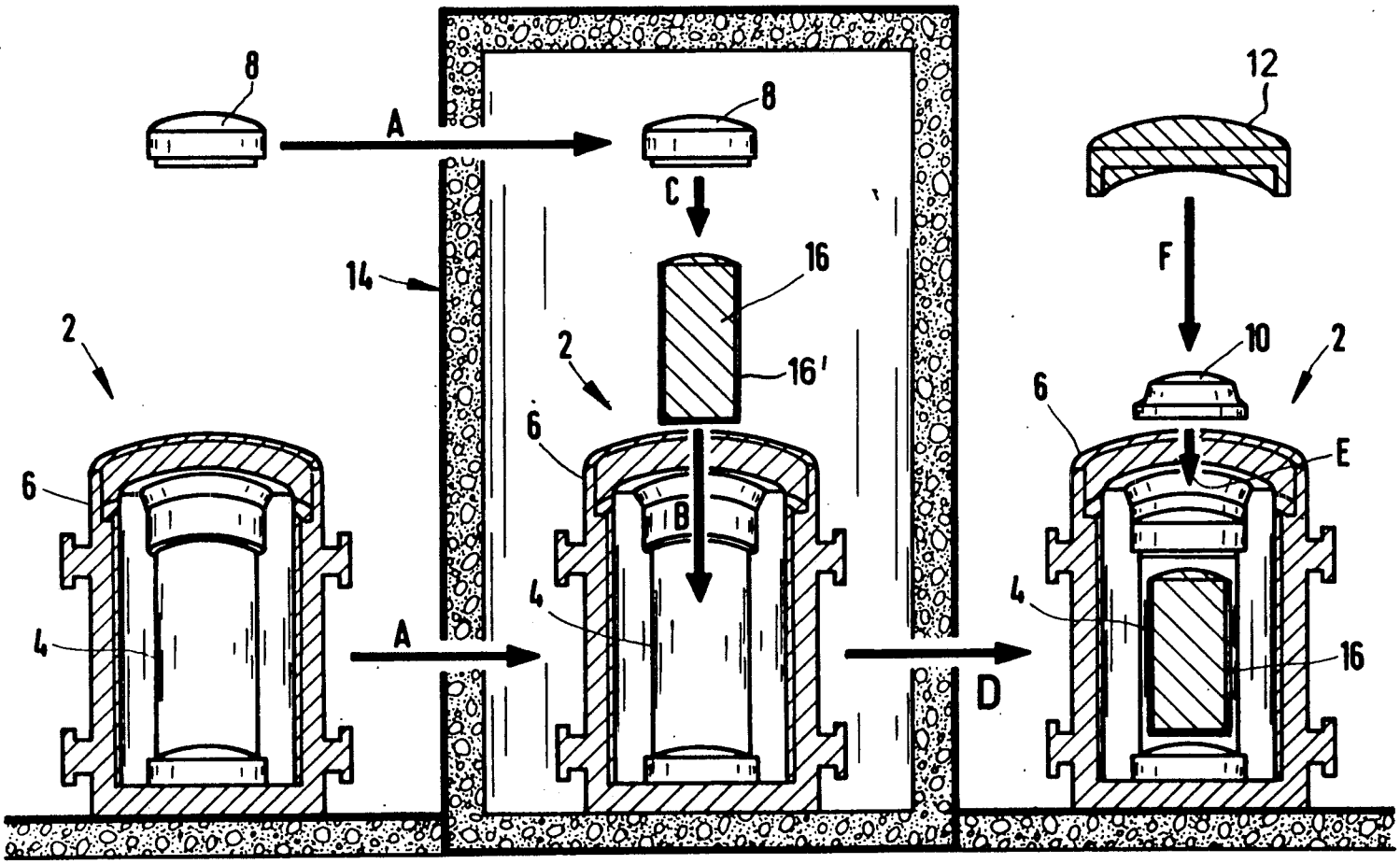

FIG. 1*a* depicts schematically a first method for loading and sealing a double container system 2, consisting of a removable inner container 4 of steel and an outer shielding container 6 in six steps, designated A, B, C, D, E, and F. The inner container 4 has a screw-in inner cover 8 and a weld-on outer cover 10 and the shielding container 6 has a screw-on shielding cover 12.

For loading and sealing, in a first step A, the empty double container system 2 is injected into a shielded chamber 14, for example, a so-called hot cell. In the second step B, in the shielded chamber, the open inner container 4 is loaded through the top opening of the shielded container 6 with radioactive material 16 which is enclosed in and is to be stored in a sheath (box, metal mould) 16'. In the third step C, the inner container while still in the hot cell is sealed with the screw-in inner cover 8, and the seal of the screw-in cover is tested. In the fourth step D, the ejection from chamber 14 of the double container system which is loaded and sealed with the inner cover 8 takes place. In step E, outside of the shielded chamber, the outer cover 10 is welded to the inner container 4, and after the welding is complete, the weld is tested. Finally, in the last step F, the shielding cover 12 is screwed onto the shielding container 6.

Figure 1B:
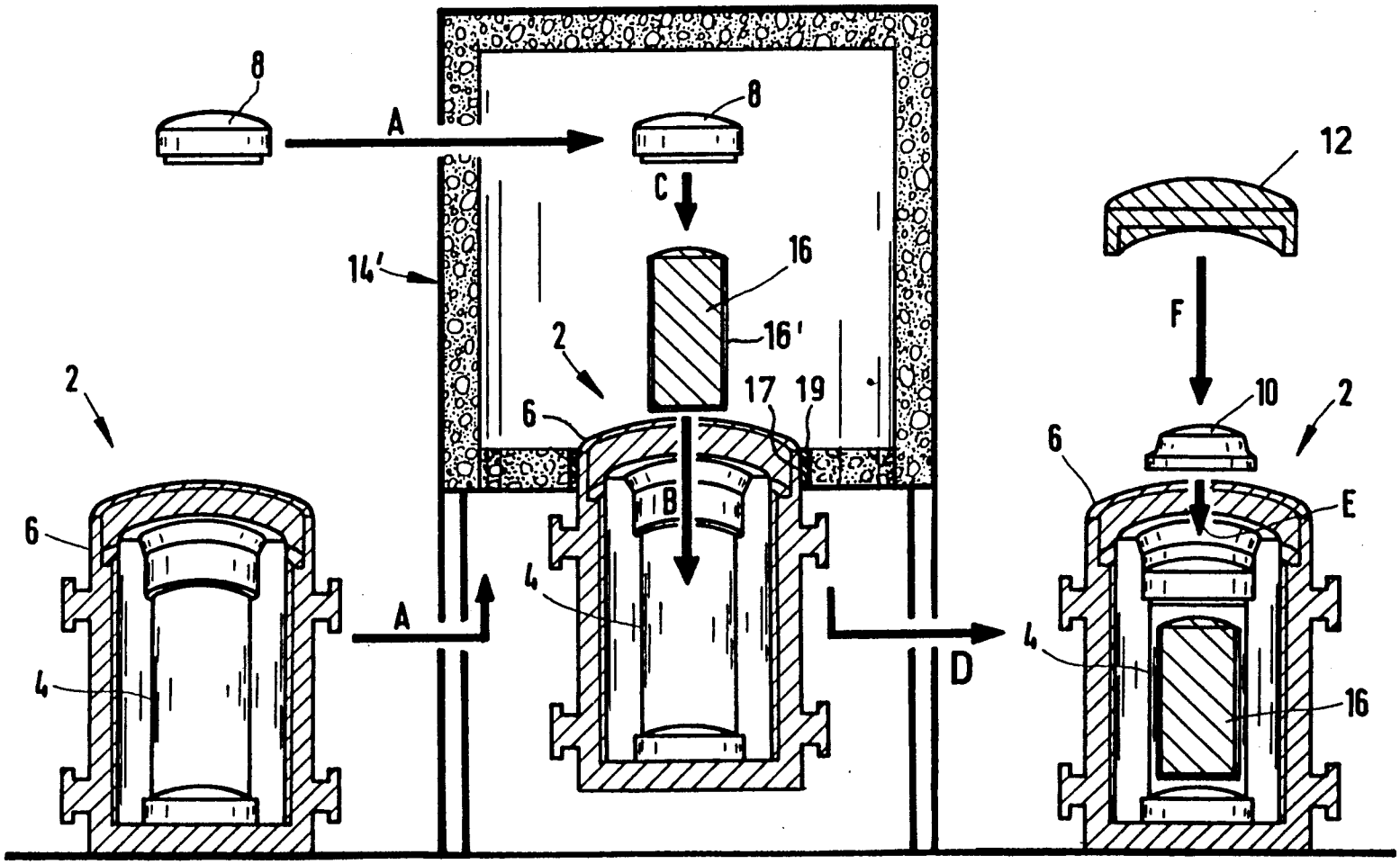

FIG. 1*b* depicts schematically a second method for loading and sealing a double container system 2, consisting of a removable inner container 4 of steel and an outer shielding container 6 in six steps, A, B, C, D, E, and F. The inner container 4 has a screw-in inner cover 8 and a weld-on outer cover 10 and the shielding container 6 has a screw-on shielding cover 12.

For loading and sealing in a first step A, the empty and open double container system 2 is locked or gripped from below the hot cell (shielded chamber) 14', specifically within an injection aperture 17 located in the floor of the cell. The seal of the injection aperture is not depicted, but it is understood that suitable, known transport and lifting devices are used and that the docked double container system 2 is arranged absolutely sealed and shielded in the injection aperture 17, as is indicated by means of the seal/shield 19. In the second step B, the inner container 4 is loaded from the hot cell 14' with the radioactive material 16 which is to be stored and which is enclosed in a sheath 16'. In the third step C, the inner container 4 is sealed with the screw in cover 8 while the double container system 2 is still locked in the injection aperture 17, and the screw-in cover seal is tested. In the fourth step D, the sealing of the injection aperture 17 and the loosening and removal from the hot cell 14 of the loaded double container system 2, now sealed with the inner cover 8, takes place. After this, in step E, outside of the shielded region, the outer cover 10 is welded to the inner container 4, and after the welding is complete, the weld is tested. Finally, in the last step F, the shielding cover 12 is screwed to the shielding container 6.

Figure 2:
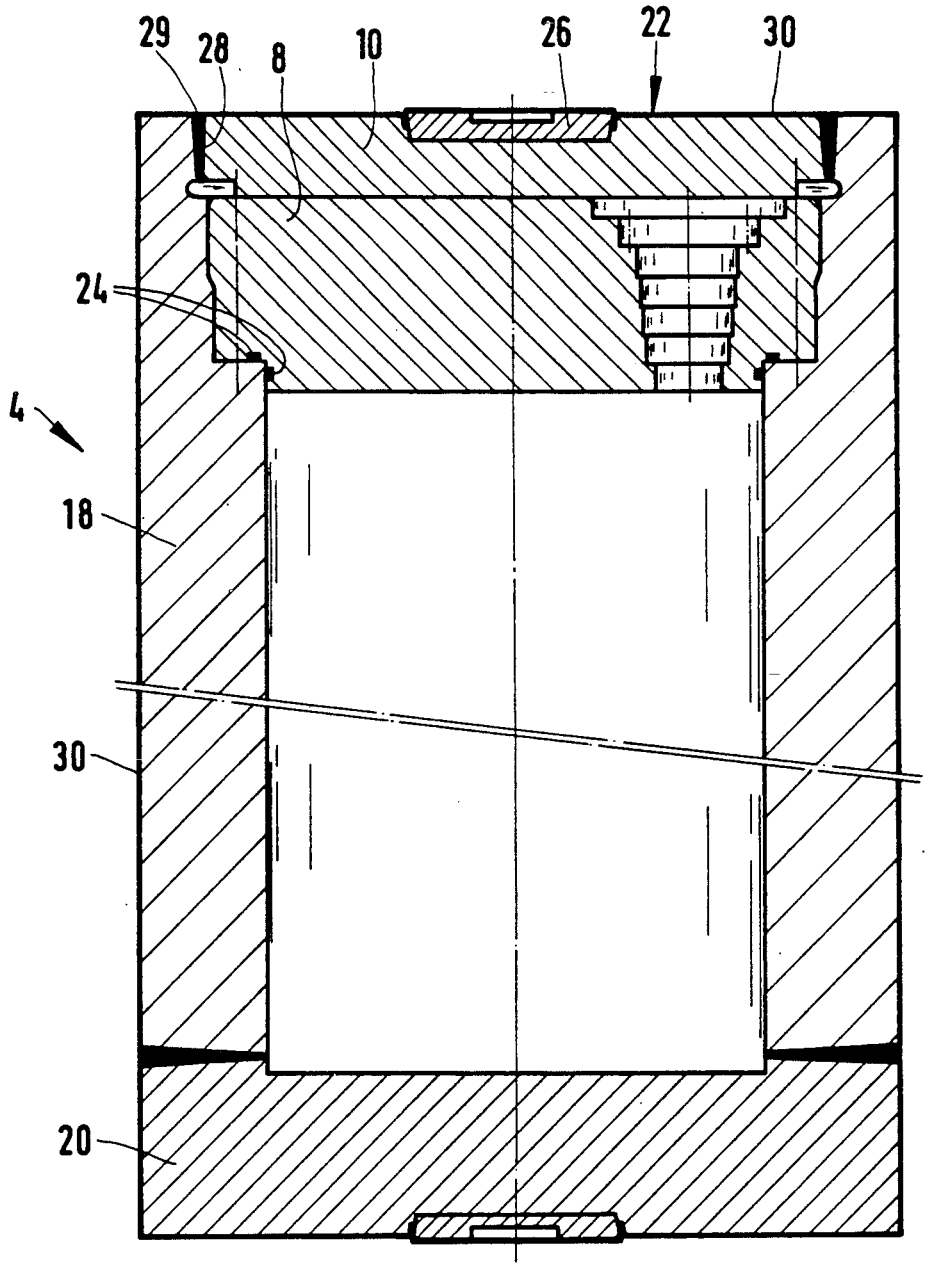
FIG. 2 is a sectional view of an inner container with a seal designed according to the invention.

The inner container 4 which is depicted in greater detail in FIG. 2 consists of a cylindrical jacket 18, a floor 20, and a seal 22. The seal 22 consists of the inner cover 8 which is designed as a sealing plug, and can be screwed into the jacket 18 against bottom and side seals 24, and the outer cover 10, which is designed as a sealing plug with a handle 26, which outer cover is welded to the jacket 18 of the inner container 4.

A welding gap 28 is left between the outer cover 10 and the jacket 18 for the application of a weld 29 between the cover and the jacket by means of narrow-gap welding. The sealed container is further provided with a welded-on plasma hot wire cladding layer 30 for corrosion protection.

Figure 3:
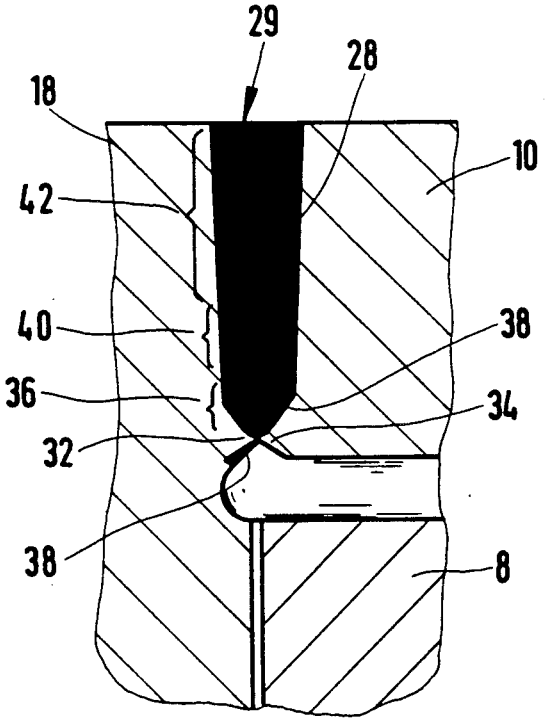
FIG. 3 is a sectional view through a weld connection between the seal cover and the inner container jacket.

FIG. 3 shows the weld in more detail. The welding gap 28 between the outer cover 10 and the container jacket 18 widens slightly toward the top and is limited on the bottom by means of two surrounding welding flanges 32 and 34 which lie opposite one another, of which one is located on the jacket and the other on the outer cover 10.

The welding flanges 32 and 34 are canted to attain a clean weld root 36. The cant 38 amounts to about 45° and is preferably provided both on the top and on the bottom sides of the welding flanges. The canting has the advantage that heat dissipation from the weld point is improved. Also, the canting facilitates the introduction and positioning of the outer cover 10.

The root welding is performed preferably by means of an inert gas-shielded arc welding device with tungsten electrodes ("WIG" welding device), with which a very precise weld can be performed. Onto the weld root 36, further weld layers 40 are welded with the inert gas-shielded arc welding device with tungsten electrodes, the purpose being to securely prevent burn-through during the following welding of the remaining weld layers 42 by means of a submerged arc welding system ("UP" welding system), with which large quantities of welding metal can be applied.

The welding of the root thereby proceeds preferably with the help of at least two "WIG" welding heads, which lie opposite one another and operate simultaneously. This prevents distortion of the cover and thus a disruption of the uniformity of the welding gap during the welding process, and finally the danger of forming an uneven welded root and possible fissures.

The final welding performed as narrow-gap submerged arc welding has the advantage, since it welds thicker cross-sections than has presently been the case, that it leads to lower production of heat and leads to a more uniform build-up of the weld layers and thus of the weld itself. The weld material of the edge layers molds to the edges of the welding gap between the cover and the container jacket, whereby the coarse grain is almost completely converted to fine grain by the following layer. Thus the necessary condition is created for eliminating resulting voltage warming and cooling, and it is assured that the material values of the weld lie within the framework of the material values of the base material.

Figure 4:
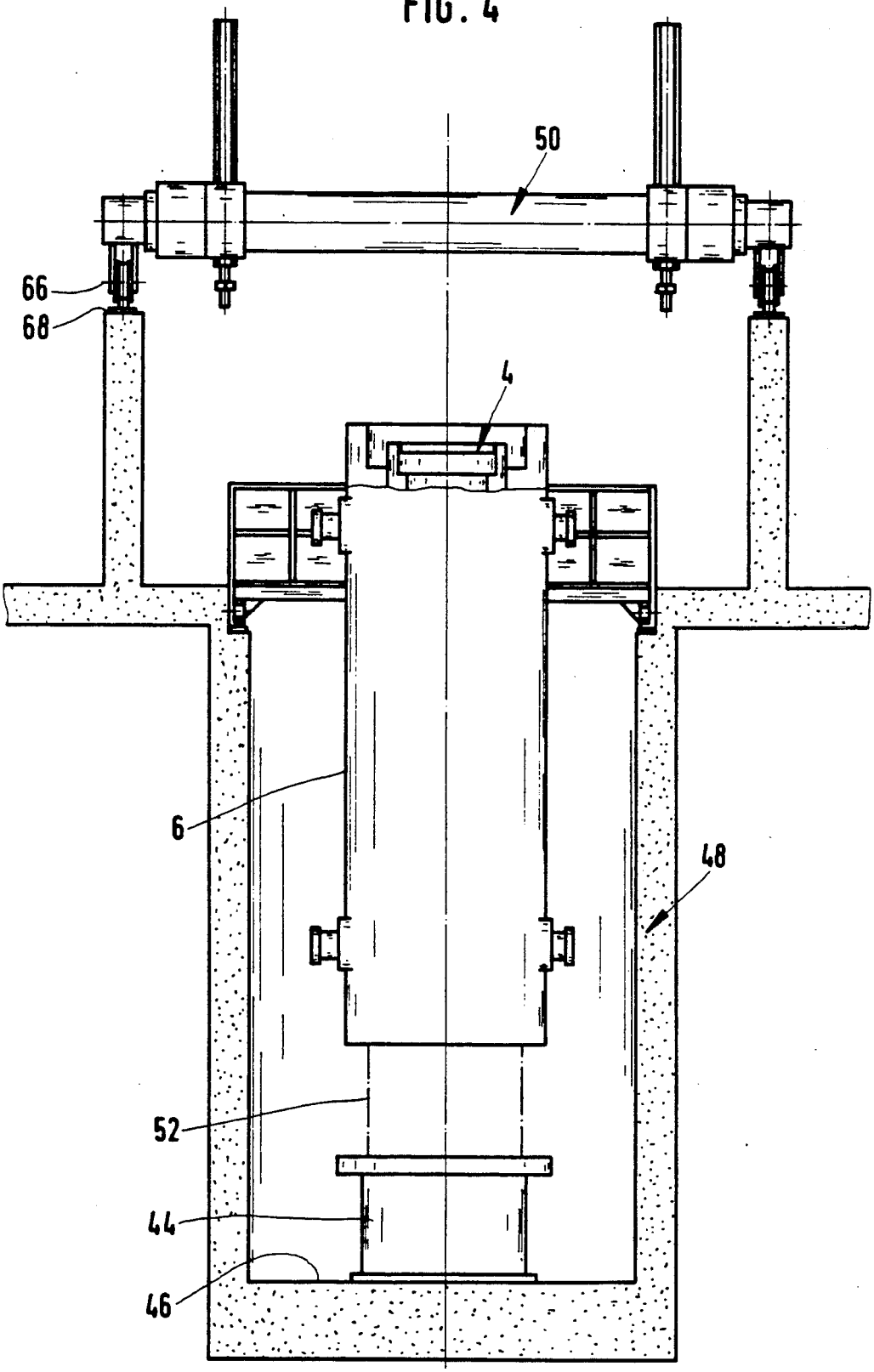
FIG. 4 is a schematic elevational view of a device for the production of the seal according to FIGS. 2 and 3.
Figure 5:
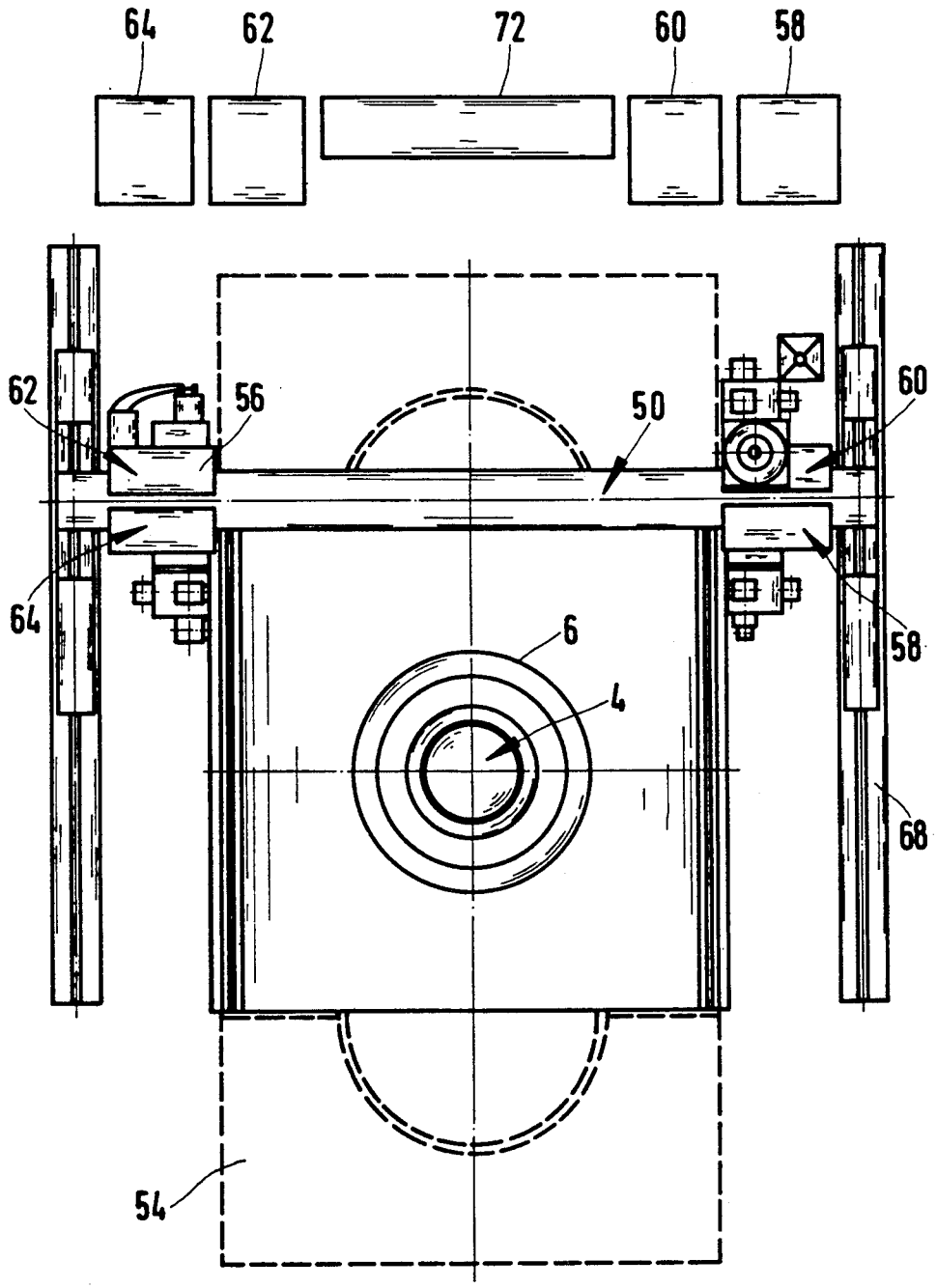
FIG. 5 is a schematic plan view of the device of FIG. 4.
Figure 6:
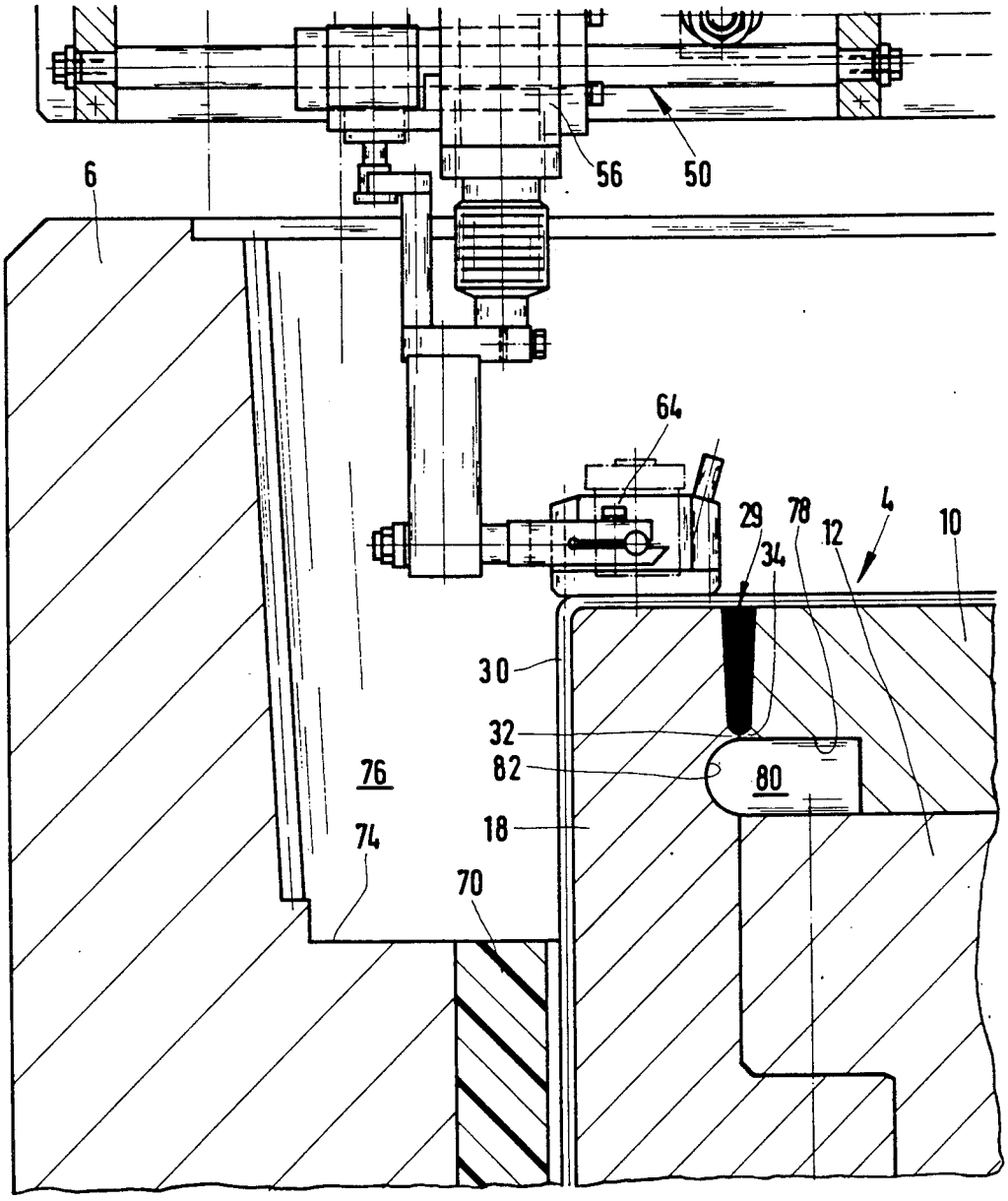
FIG. 6 is an enlarged, detail of a part of the device shown in FIGS. 4 and 5.

The production of the seal takes place with the help of a device depicted in FIGS. 4 through 6. The shielding container 6, into which the inner container 4 is inserted, is set on a horizontal rotary table 44, which is anchored to the floor 46 of a foundation pit 48. Where applicable, the inner container 4 can be set on the rotary table alone. The rotary table is equipped with a spherical turning connection to absorb horizontal and axial forces. The rotary table is driven by means of a motor within a low rotational speed range. The top of the table has a mechanical stage which is adjustable with a motor for the precision positioning of the container under the welding and testing movable bridge 50.

Since the foundation pit 48 should be able to be used for containers of various sizes, spacing pieces 52 (drawn in dot-and-dash lines) are placed on the rotary table for equalization of length so that the sealing weld will always take place at the same height above the floor.

A pit cover 54 (FIG. 5) is provided which is put on during loading of the rotary table with the help of a crane. It is moved over the concrete pit and can be walked on during the loading process.

All welding, testing and other devices are mounted on the bridge 50. The movable bridge 50 has several interior tracks (not depicted) which serve for guiding transport carriages 56 and the welding and testing devices 58, 60, 62, 64 which are fastened on them.

The bridge 50 is equipped with a traveling gear 66 (FIG. 4) with flanged wheels and a direct current drive by which the bridge can be driven at both positioning speed and rapid traverse speed along raised tracks 68 which are arranged on both sides of the foundation pit.

The drives of the transport carriages are supplied with power separately, and each transport carriage has a height adjustment with which the complete welding or testing device can be moved into operating or waiting position.

The welding and testing devices encompass an inert gas-shielded arc welding device with tungsten electrodes (WIG) 58, submerged arc welding device ("UP") 60, a plasma hot-wire welding device ("PH") 62 and a testing device 64.

FIG. 6 shows a part of the welding and testing bridge 50 in greater detail with a testing device 64 in the operating position. The weld 29 and the application of the corrosion protection layer 30 have already taken place. The operating position of the welding devices 58 or 60 are quite analogous in appearance. It can be easily seen from FIG. 6 that the welding and testing of the outer cover 10 is to be performed with the inner container 2 inserted in the shielding container 6. Reference number 70 indicates a moderator.

The complete welding and testing process preferably occurs automatically, for which purpose a control device 72 (FIG. 5) is provided. Otherwise, control panels are provided, from which the welding and testing devices can be controlled.

If desired, the welding and testing devices can be mounted on bracket arms (not depicted), rather than on bridge 50.

To guarantee optimum testing of the weld 29, the shielding container has a step-shaped, annular mouth 74 extending above the weld so that a sufficient free space arises between the shielding container and the inner container to insert and move the testing device 64 (FIG. 6). Furthermore, the outer cover 10 of the inner container 4 has provided on its bottom side below the welding flange 34 an annular, step-shaped recess 78, by means of which an annular chamber 80 is formed between the outer cover 10 and the inner cover 8, which continues in an annular groove 82 formed below the welding flange 32 of the container jacket in the inner wall of this jacket.

What is claimed is:

1. In a double container system loaded with radioactive material disposed in a sheath comprising an inner container and an outer shielding container, the improvement in which said inner container has a cylindrical wall, an inner cover in the form of a plug screwed into said wall and an outer cover welded to said wall, said weld comprising a welding gap between said outer cover and said wall, said gap being of increasing width from bottom to top, the bottom of said gap being formed by a pair of opposed peripheral flanges, one projecting from said outer cover and one projecting from said wall, each said flange being canted to provide said gap with a bottom of V-shaped configuration, a weld disposed within said welding gap having a root layer disposed on said V-shaped bottom and an added layer superimposed on said root layer said root layer being formed by a tungsten electrode, gas shielded arc welding process and said added layer being formed by a submerged arc welding process.

2. The double container system of claims 1 in which said shielding container has a step-shaped annular mouth extending above said weld to provide sufficient free space between said shielding container and said inner container to accommodate a weld testing device.

3. The double container system of claim 1 in which the bottom of said outer cover has an annular recess beneath said weld and said cylindrical wall has a groove which joins said recess to provide an annular chamber beneath said weld.

4. The double container system of claim 1 in which each of said flanges is canted on the upper and lower surfaces thereof at an angle of about 45°.

* * * * *